US005676080A

United States Patent [19]

Allen

[11] Patent Number: 5,676,080

[45] Date of Patent: Oct. 14, 1997

[54] WATERCRAFT

[75] Inventor: Terence Vance Allen, Queensland, Australia

[73] Assignee: Quintrex Australia PTY Ltd., Australia

[21] Appl. No.: 648,289

[22] Filed: May 15, 1996

[51] Int. Cl.[6] ..... B63B 3/00

[52] U.S. Cl. ..... 114/65 R; 114/356; 72/296

[58] Field of Search ..... 114/355, 356, 114/65 R, 79 R, 79 W, 80; 72/295–297

[56] References Cited

U.S. PATENT DOCUMENTS

| | | | |
|---|---|---|---|
| 1,246,017 | 11/1917 | Curtiss . | |
| 2,165,545 | 7/1939 | Grant . | |
| 2,400,771 | 5/1946 | Moxham, Jr. . | |
| 2,511,816 | 6/1950 | Shaw . | |
| 2,758,321 | 8/1956 | Westfall . | |
| 3,024,478 | 3/1962 | Plum . | |
| 3,190,587 | 6/1965 | Fries . | |
| 3,264,020 | 8/1966 | De Ridder . | |
| 3,282,761 | 11/1966 | Evangelist . | |
| 3,388,446 | 6/1968 | Phillips | 114/356 |
| 3,459,025 | 8/1969 | Bath | 72/296 |
| 3,559,222 | 2/1971 | Walker . | |
| 3,670,683 | 6/1972 | Bruniaux et al. . | |
| 3,855,044 | 12/1974 | Riel . | |
| 4,214,332 | 7/1980 | Stoner . | |
| 4,566,397 | 1/1986 | Cavanaugh et al. . | |
| 4,572,096 | 2/1986 | Payne | 114/356 |
| 4,739,722 | 4/1988 | Rogstad . | |
| 4,744,320 | 5/1988 | Johnston | 114/65 R |
| 4,760,811 | 8/1988 | Hopper . | |
| 5,086,725 | 2/1992 | Garrett et al. . | |
| 5,277,145 | 1/1994 | Hordis . | |
| 5,279,249 | 1/1994 | Pepper . | |
| 5,355,828 | 10/1994 | Pepper . | |

*Primary Examiner*—Edwin L. Swinehart
*Attorney, Agent, or Firm*—VanOphem Meehan; VanOphem, P.C.

[57] ABSTRACT

Each keel panel for a punt-like boat is formed from aluminum sheet having a relatively low temper/high degree of extensibility and the bow portion is stretched formed over a die in a metal stretching machine. The hull construction of the boat has a keel, chines and gunwales formed from aluminum extrusions, interconnected by transverse ribs, where the keel panels are connected to the keel, chines and gunwales but are not connected to the ribs to permit limited movement relative thereto.

8 Claims, 6 Drawing Sheets

WATERCRAFT

BACKGROUND OF THE INVENTION

1. Field of the Invention

This invention relates to watercraft. This invention further relates to an improved method of construction of watercraft, and of keel panels therefor.

2. Prior Art

Small punt-like boats are commonly used for recreational transport and fishing on the still-water lakes and rivers in the USA. With these punt-like boats having Vee-shaped bows, the complex shapes of the keel panel(s) (to manufacture the hulls) has restricted the manufacture of such boats, on a commercial basis, to the use of the fiberglass hulls. While hulls of steel or aluminium sheet can be manufactured, the complex shapes of the keel panels require the panels to be built up in small sections and then fixed (e.g., welded) to the hull frame.

SUMMARY OF THE PRESENT INVENTION

It is an object of the present invention to provide a watercraft, of the punt-like type with a Vee-shaped bow, where the hull can be constructed of sheet metal on a hull frame.

It is a preferred object to provide a watercraft where the keel panels are formed by stretching the sheet metal over a die into the desired shape.

It is a further preferred object to provide a watercraft which has softer riding characteristics than conventional craft due to its hull shape and form of construction.

In a still further preferred object, the present invention resides in an improved method of constructing a watercraft.

Other preferred objects will become apparent from the following description.

In one aspect, the present invention resides in a method of forming a keel panel from a metal sheet for a watercraft including the steps of:

forming a plurality of spaced, substantially Vee-shaped longitudinal ribs in the metal sheet;

placing the metal sheet, at least adjacent one end, over a die of a metal stretching machine, the die having a convex longitudinal profile and a concave transverse profile, the ribs being directed away from the die;

attaching each end of the metal sheet to a respective jaw of the metal stretching machine; and moving the jaws apart to cause the metal sheet to be pulled into, and stretched over, the die to cause a bow portion to be formed at the one end of the metal sheet.

Preferably, the metal sheet is formed of aluminum sheet of a thickness of 2 mm to 3 mm with a relatively soft temper and relatively high degree of extensibility, the stretching of the aluminum work-hardens the aluminum to increase its effective strength.

Preferably, the metal sheet, after the bow portion is formed, is cut to shape for attachment to a keel, chine and gunwale of a watercraft frame formed from aluminium extrusions.

In a second aspect, the present invention resides in a method of manufacturing a watercraft having a substantially Vee-shaped bow including the steps of:

forming a frame incorporating a keel, a pair of chines and a pair of gunwales, each formed of aluminium extrusions, with first transverse ribs interconnecting the keel and the chines; and attaching a respective keel panel, formed by the method as hereinbefore described, to the keel, a respective one of the chines and a respective one of the gunwales in a water-sealed configuration, the keel panel being engageable with, but not fixed to, the first transverse ribs connecting the keel and the chine to enable the keel panel at least limited movement relative to the first transverse ribs.

Preferably, the keel panels are welded or brazed to the keel, chines and gunwales, In a third aspect, the present invention resides in a watercraft formed by the method hereinbefore described, wherein:

the hull is substantially flat at the rearward end for stability at rest, with a substantially Vee-shaped bow portion to cut water and generate some lift, the limited movement of the keel panels relative to the frame reducing water-generated shocks on the watercraft to generate a relatively smooth ride characteristic.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
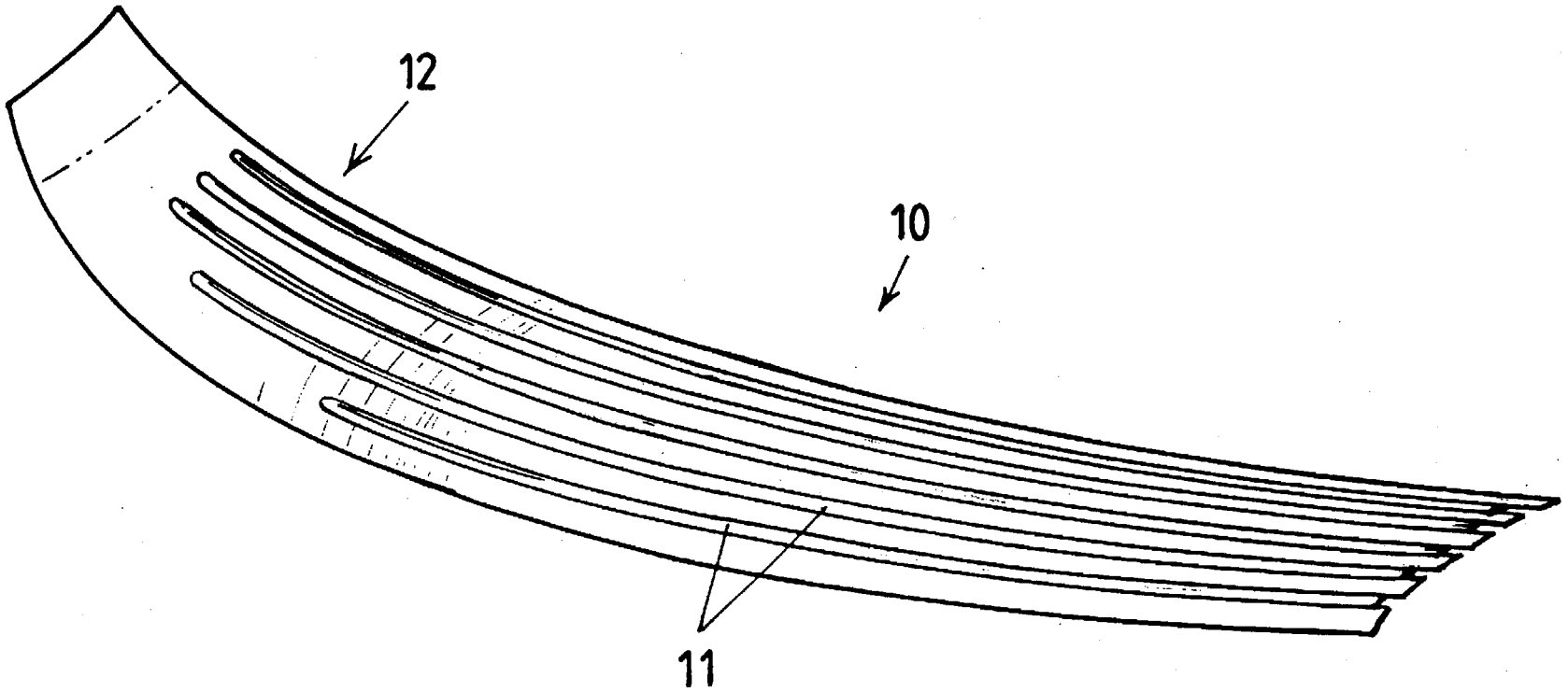
FIG. 1 is a perspective view of a formed keel panel (for the right-hand side of the hull)

Referring to FIG. 1, the keel panel 10 is formed from a length of aluminum sheet with a relatively low hardness temper and high degree of extensibility. A suitable sheet is 2 mm thick sheet sold by Capral Aluminium under a temper code "H22". (Conventional aluminium sheeting for small watercraft has a temper code "H34".)

A plurality of substantially parallel, spaced, longitudinal ribs 11 (of substantially Vee-section—see FIG. 8) are pressed or rolled into the panel 10.

Figure 3:
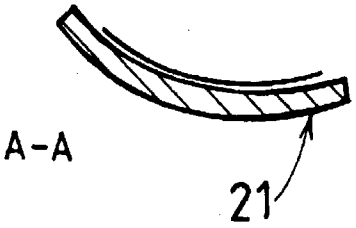
FIG. 3 is a sectional end view of the stretching die taken on line A—A on FIG. 2.
Figure 2:
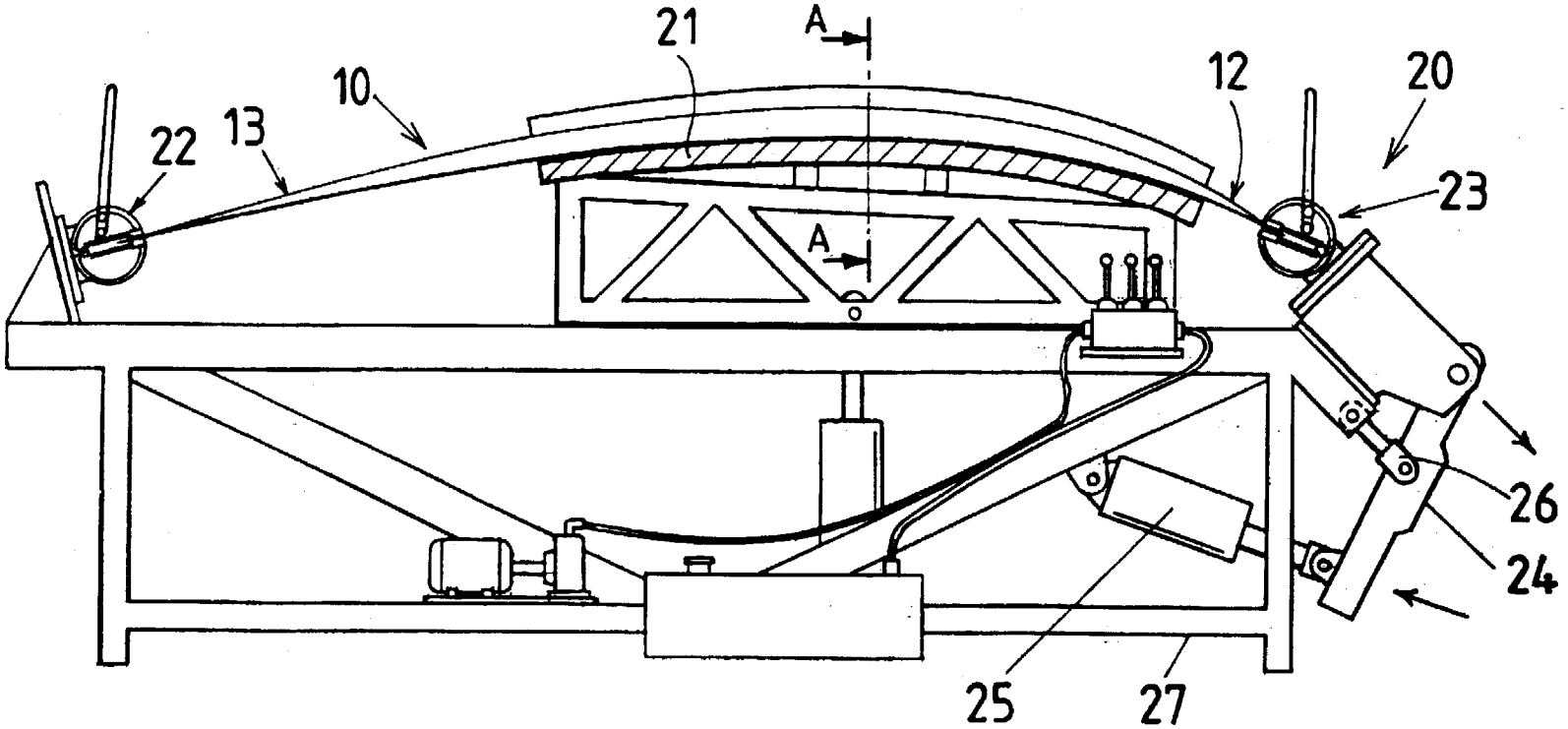
FIG. 2 is a side view of the metal stretching machine.
Figure 4:
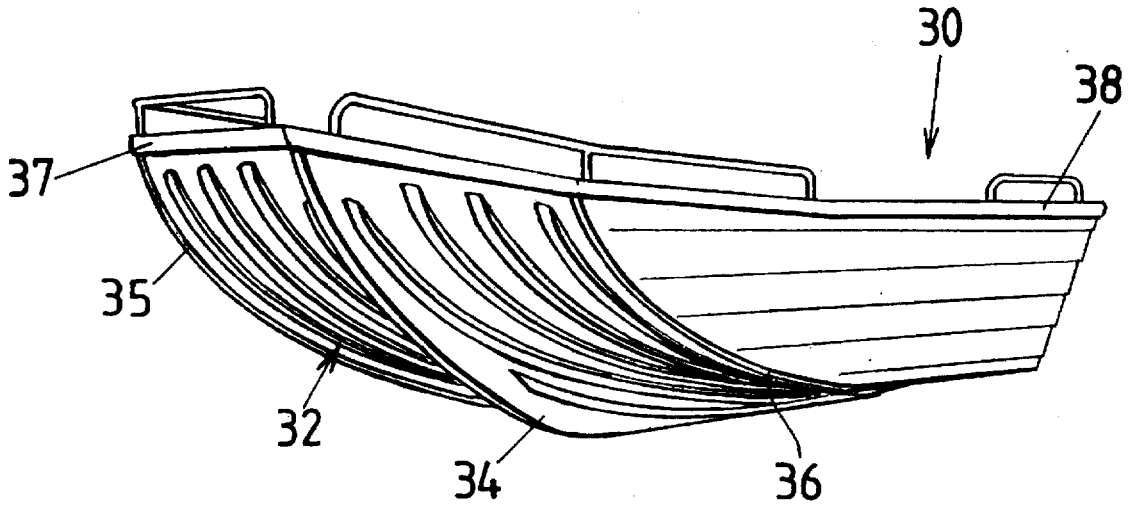
FIGS. 4 to 6 are respective front perspective views of the watercraft taken from different lines of sight.
Figure 5:
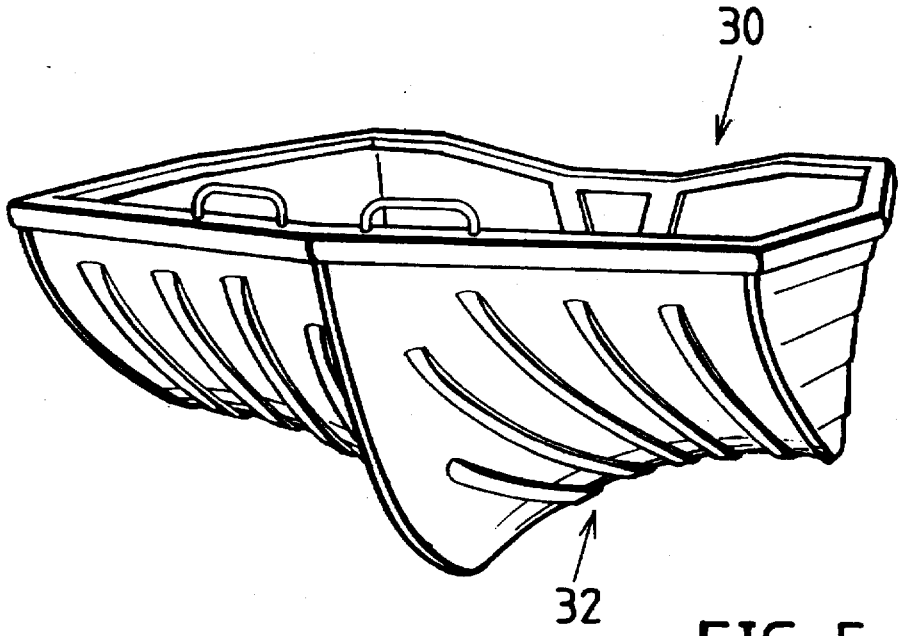
Figure 6:
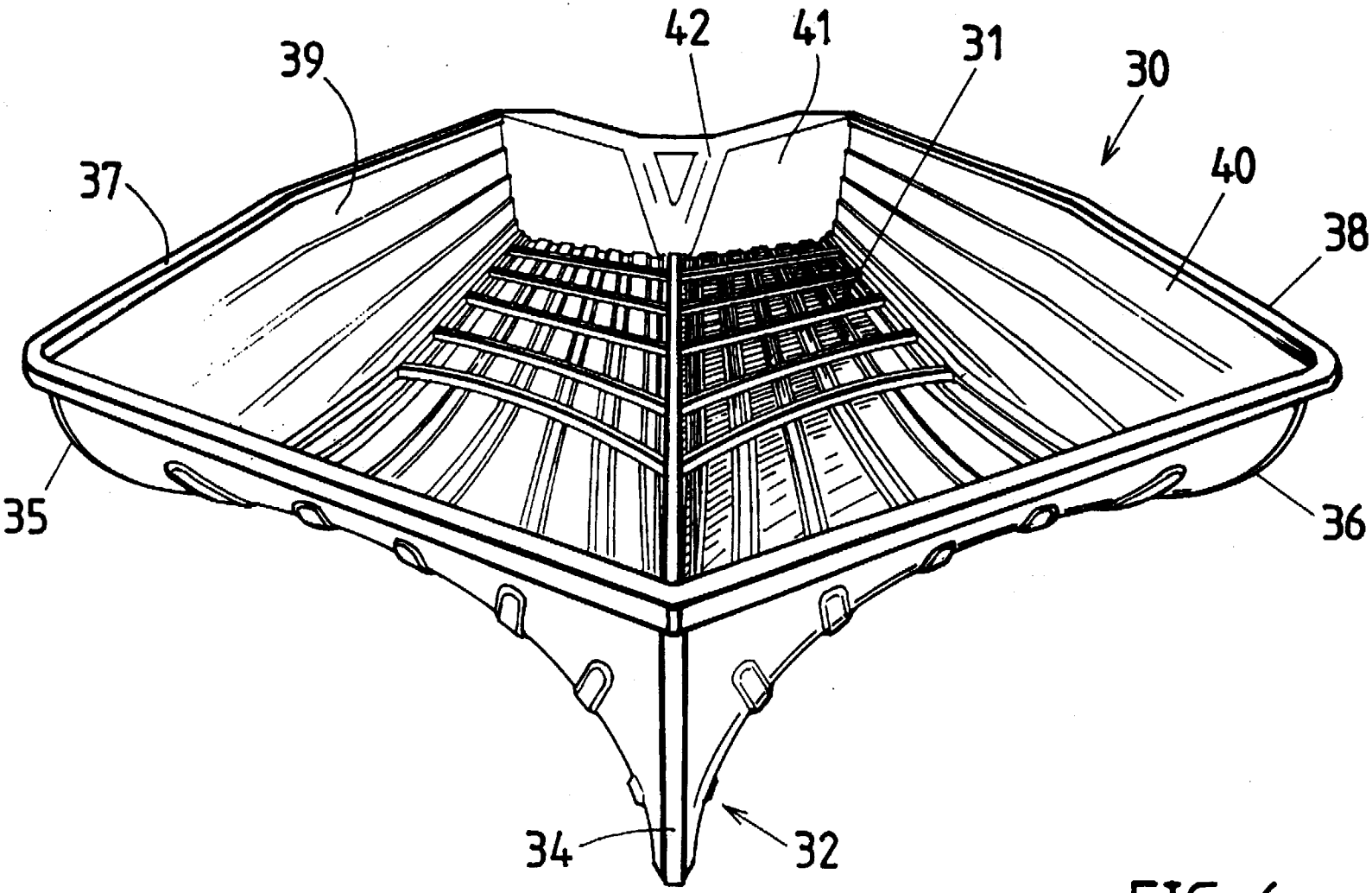
Figure 7:
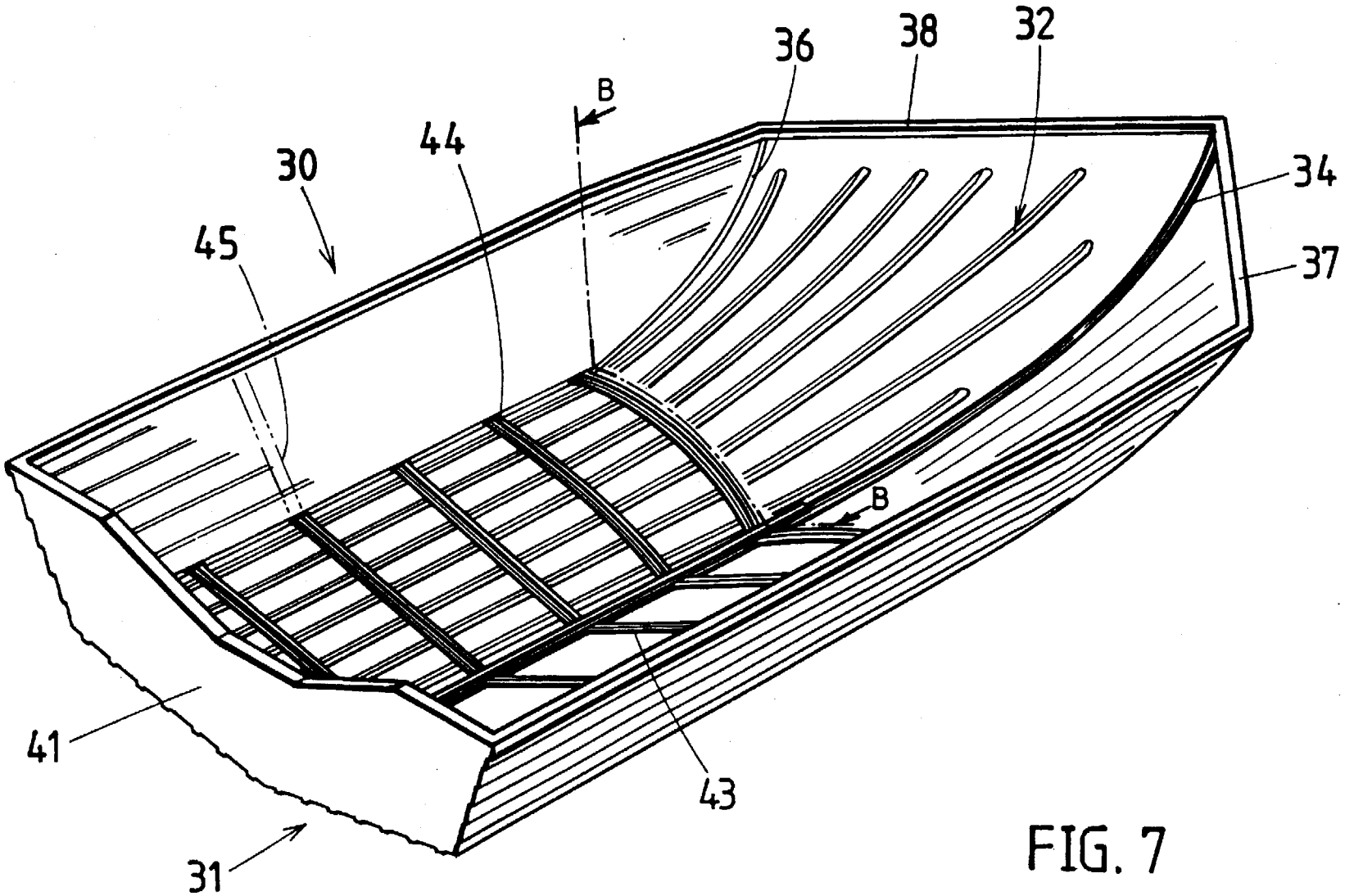
FIG. 7 is a rear perspective view of the watercraft.

The panel 10 is inverted (i.e., the ribs are directed upwardly) and is placed with the intended bow portion end 12 over a metal stretching die 21 in a metal stretching machine 20. The die 21 is convex in the longitudinal direction of the panel 10 but concave in the transverse direction—see FIG. 3.

The stem end 13 of the panel 10 is secured in a fixed jaw 22 on the stretching machine 20. The bow end 12 is secured in a movable jaw 23 which is connected via a rocker arm 24 to a ram 25. A link 26 pivotally mounted on a frame 27, provides a movable pivot point for the rocker arm 24. As the ram 25 is retracted, the movable jaw is advanced and moved downwardly to draw the panel 10 down into, and over, the die 21, to form the complex shape of the bow portion 12. The die 21 is shaped so that the convex/concave curves are of smaller diameter than the final curves of the bow shape as the metal will "relax" to a small degree when the movable jaw 23 is retracted. As the panel 10 is stretched over the die 21, the aluminum is work-hardened by the stretching so that the 2 mm thick sheet has the strength of the standard 3 mm sheet.

As shown in FIGS. 4 to 7, the watercraft 30 is of a punt-like type but has a substantially planar (or shallow Vee) rear hull section 31 for stability at rest and low speeds, and a Vee-section bow 32 which is designed to cut through the water. In addition, the tunnel-like shape formed by each keel panel 10 traps air to create lift and to soften the ride characteristics of the watercraft. These characteristics are further enhanced by the method of construction now to be described.

Figure 8:
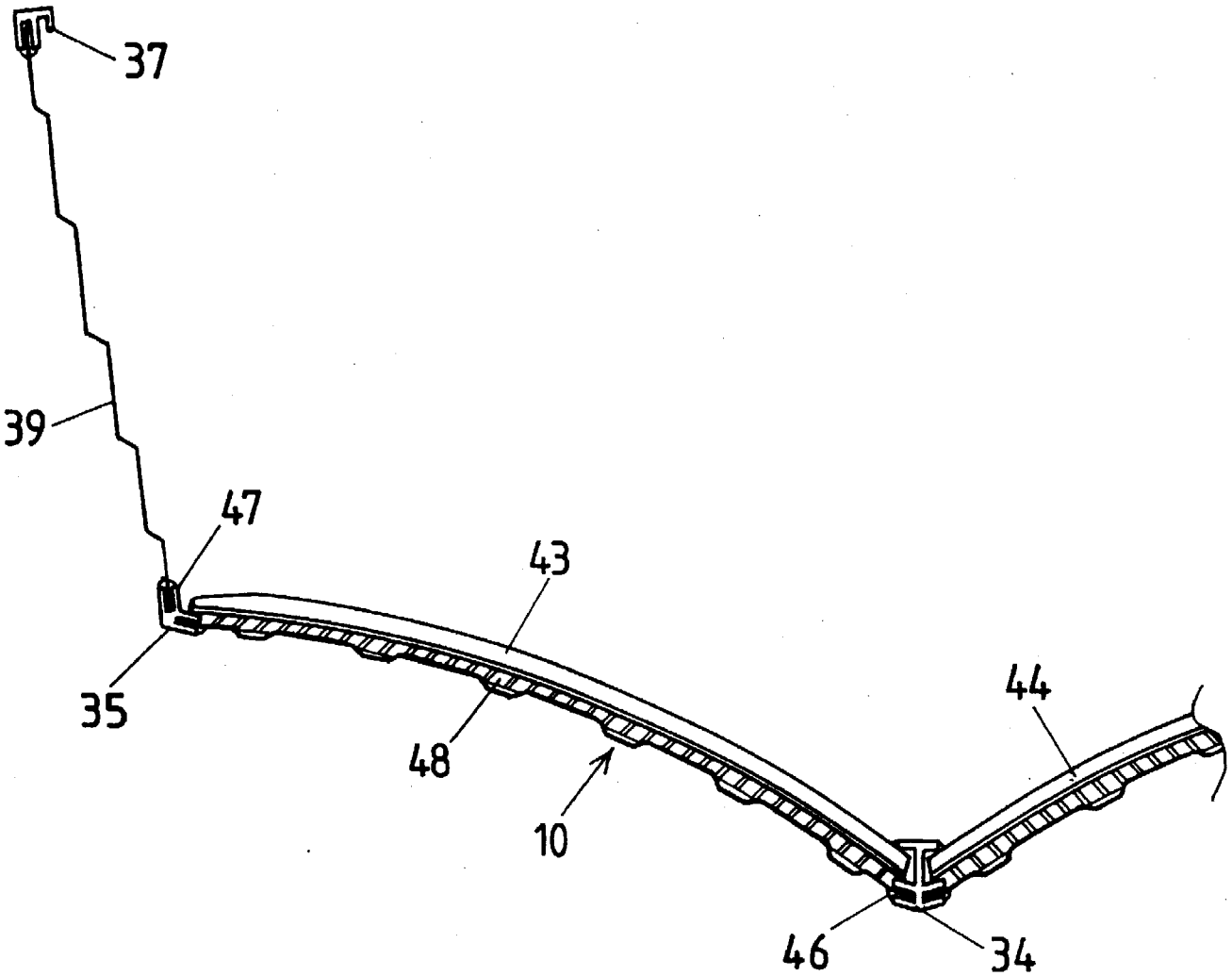
FIG. 8 is a sectional end view taken on line B—B on FIG. 7.

The hull is constructed with a keel 34, chines 35, 36 and gunwales 37, 38 formed of aluminum extrusions—see FIG. 8. Side panels 39, 40 of ribbed aluminium sheet connect the chines 35, 36 and gunwales 37, 38 respectively and the stern section 41 has mountings 42 for an outboard motor (not shown). Unlike conventional U.S. construction which employs longitudinal stringers, transverse ribs 43, 44 interconnect the keel 34 to the chines 35. 36. (Secondary ribs 45 may connect the chines to the gunwales.)

The keel panels 10 are received in slots formed in the keel 34 and chines 35, 36 and may be welded or brazed thereto, as shown at 46, or engaged in water-tight sealing strips 47. The panels 10 are not fixed to the ribs 43, 44 and a rubbing strip 48 (e.g., of neoprene tape) may be provided between the panels 10 and the ribs 43, 44. (In FIG. 8, the thickness of the rubbing strip 48 has been exaggerated for ease of identification.)

In use, the panels 10 can move at least a limited amount relative to the ribs 43, 44 when the watercraft passes through rough water or encounters waves. This movement (or flexing) of the keel panels 10 co-operates with the ride characteristics due to the low profile to further smooth the ride of the watercraft. While the keel panels 10 may be securely fixed around their periphery (e.g., by welding) to the keel 34, chines 35, 36 and gunwales 37, 38, they are not held rigid by the ribs 43, 44 and so can move or deform in a shock-absorbing manner. This would not be possible if the panels 10 were welded or fixed to the ribs to form a rigid structure.

By forming the keel panels 10 by stretching the aluminium sheet to shape, and the limited allowable flexing of the panels when fitted to the hull frame, it is possible to economically manufacture this type of watercraft in metal and provide greater strength and improved ride characteristics over known watercraft.

Various changes and modifications may be made to the embodiments described and illustrated without departing from the present invention defined in the appended claims.

I claim:

1. A method of forming a keel panel from a metal sheet for a watercraft including the steps of:

forming a plurality of spaced, substantially Vee-shaped, longitudinal ribs in the metal sheet;

placing the metal sheet, at least adjacent one end, over a die of a metal stretching machine, the die having a convex longitudinal profile and a concave transverse profile, the ribs being directed away from the die;

attaching each end of the metal sheet to a respective jaw of the metal stretching machine; and moving the jaws apart to cause the metal sheet to be pulled into and stretched over, the die to cause a bow portion to be formed at the one end of the metal sheet.

2. A method as claimed in claim 1 wherein:

the metal sheet is formed of aluminum sheet of a thickness of 2 mm to 3 mm with a relatively soft temper and relatively high degree of extensibility, the stretching of the aluminum work-hardening the aluminum to increase its effective strength.

3. A method as claimed in claim 1 wherein:

the metal sheet, after the bow portion is formed, is cut to shape for attachment to a keel, chine and gunwale of a watercraft frame formed from aluminium extrusions.

4. A method of manufacturing a watercraft having a substantially Vee-shaped bow including the steps of:

forming a frame incorporating a keel, a pair of chines and a pair of gunwales, each formed of aluminium extrusions, with first transverse ribs interconnecting the keel and the chines; and attaching a respective keel panel, formed by the method of claim 1, to the keel, a respective one of the chines, and a respective one of the gunwales in a water-sealed configuration, the keel panel being engageable with, but not fixed to, the first transverse ribs connecting the keel and the chine to enable the keel panel at least limited movement relative to the first transverse ribs.

5. A method as claimed in claim 4 wherein:

the keel panels are welded or brazed to the keel, chines and gunwales.

6. A method as claimed in claim 4 wherein:

the edges of the keel panels are sealably engaged in grooves in the keel, chines and gunwales.

7. A method as claimed in claim 4 wherein:

second transverse ribs connect the chines and the gunwales.

8. A watercraft formed by the method of claim 4 wherein:

the hull is substantially flat at the rearward end for stability at rest, with a substantially Vee-shaped bow portion to cut water and generate some lift, the limited movement of the keel panels relative to the frame reducing water-generated shocks on the watercraft to generate a relatively smooth ride characteristic.

* * * * *

UNITED STATES PATENT AND TRADEMARK OFFICE

CERTIFICATE OF CORRECTION

PATENT NO. : 5,676,080
DATED : October 14, 1997
INVENTOR(S) : Terence Vance Allen It is certified that error appears in the above-identified patent and that said Letters Patent is hereby corrected as shown below:

Column 1, line 15, delete "," insert ---- . ---- .

Column 2, line 10, delete "," insert ---- . ----.

Column 2, line 56, delete "stem" insert ---- stern ----.

Column 3, line 20, delete "." insert ---- , ----.

Signed and Sealed this

Twenty-seventh Day of January, 1998

*Attest:*

Bruce Lehman

BRUCE LEHMAN

*Attesting Officer*

*Commissioner of Patents and Trademarks*